United States Patent [19]

Zellaha et al.

[11] Patent Number: 4,962,600

[45] Date of Patent: Oct. 16, 1990

[54] WING ASSEMBLY FOR USE WITH A PLOW BLADE

[76] Inventors: Dennis D. Zellaha, 430b S. Zinnia, Morrison, Colo. 80465; David L. Bacon, 932 S. Logan, Denver, Colo. 80209

[21] Appl. No.: 404,740

[22] Filed: Sep. 8, 1989

[51] Int. Cl.[5] ..... E01H 5/06

[52] U.S. Cl. ..... 37/280; 37/216; 37/274; 37/281; 37/DIG. 4; 172/815

[58] Field of Search ..... 37/214–216, 37/231, 266, 274–276, 279–281, DIG. 4–5, DIG. 12, 106; 172/815, 782, 784

[56] References Cited

U.S. PATENT DOCUMENTS

| | | | |
|---|---|---|---|
| 3,430,706 | 3/1969 | Marrow | 172/815 |
| 3,477,151 | 11/1969 | Zanella | 37/280 |
| 4,073,077 | 2/1978 | Essel | 37/281 |
| 4,077,139 | 3/1978 | Fagervold et al. | 37/280 |
| 4,145,825 | 3/1979 | Bertolino | 37/280 |
| 4,356,645 | 11/1982 | Hine et al. | 172/815 X |
| 4,479,312 | 10/1984 | Turgeon | 172/815 X |
| 4,614,048 | 9/1986 | Melby | 172/815 X |
| 4,741,116 | 5/1988 | Engle et al. | 37/280 |

FOREIGN PATENT DOCUMENTS

| | | | |
|---|---|---|---|
| 49-37361 | 10/1974 | Japan | 172/815 |

OTHER PUBLICATIONS

Advertisement, Mother Truckers Supply, of a Snow Wing Attachment for Snowplows.

*Primary Examiner*—Randolph A. Reese
*Assistant Examiner*—Franco S. DeLiGuori
*Attorney, Agent, or Firm*—Timothy J. Martin

[57] ABSTRACT

A wing assembly is mountable to a plow blade driven in a direction of travel by a vehicle, and preferably left and right wing assemblies are respectively mounted on the left and right side edges of the plow blade. A representative wing assembly provides an auxillary plowing surface and has an inboard edge that is proximate the plow blade when the wing plate is mounted thereon. The wing plate is pivotally mounted on a vertical pivot axis so that it may pivot into an attack position at an obtuse angle $\theta$ to the plow blade with the inboard wing edge proximate the plow blade and an outboard portion projecting forwardly and outwardly from the front plowing surface of the plow blade. A latching structure retains the wing plate in the attack position. The pivotal mounts may be vertically aligned trunnion pins on the plow blade and matable opening on brackets defined by rear horizontal support and mounting webs on the wing plate. Where the plow blade can be canted at an obtuse angle $\phi$ with respect to the direction of travel, it is preferred that $\phi$ be at least 120° and $160° \geqq \theta \geqq 275° - \phi$.

23 Claims, 8 Drawing Sheets

WING ASSEMBLY FOR USE WITH A PLOW BLADE

FIELD OF THE INVENTION

The present invention generally relates to plow and scrapper blades mountable to vehicles and used to remove unwanted material from the surface. Specifically, the present invention is directed to plow blades, such as snowplow blades, having auxillary wing assemblies for increasing the effective width of the plow blade and for providing other plowing advantages.

BACKGROUND OF THE INVENTION

The problem of moving earth, debris, snow and other unwanted materials from the surface to be cleaned has long been recognized, and the need for equipment capable of removing such materials has steadily grown over the last several decades. In part, this growth has been spurred by the proliferation of automobiles and by desire of the general population for increased mobility.

Of particular interest to the present invention is plow blades constructed for mounting on a vehicle for purposes of snow removal, although the present invention may be used with other plow blades as well. Typically, snowplow blades are mounted to a vehicle transversely of the direction of travel. While plows are sometimes rear mounted, for example, on tractors, usually snowplow blades are mounted forwardly of the vehicle so that a travel path is cleared for the plow vehicle as the operator removes the snow. Most snowplow blades are C-shaped in cross-section about a vertical plane containing the direction of travel. Each such plow thus follows a contour that is an arcuate section of a cylindrical shell. This surface defines a plowing surface bounded by an upper edge, a lower scrapping edge and a pair of side edges.

The mounting structures for the above-described snowplows include rigid assemblies which position the plow blade at a selected orientation with respect to the direction of travel and, in some instances, this orientation may be manually adjusted over a series of discrete positionings. Other mounts include hydraulic systems that operate to cant or angle the blade at various obtuse angles with respect to the direction of travel. Thus, an operator can tilt the blade over a variety of angles with respect to the direction of travel in order to trail off materials gathered by the plow blade. Thus, the operator can trail the materials either to the left side of the vehicle or to the right side of the vehicle depending on how the blade is canted.

Despite the usefulness of these plow blades, there remain certain disadvantages. Once such disadvantage found in the standard plow blades is the relative transverse plowing width. Further, where a substantial quantity of material is being scraped with the plow blade in the transverse orientation, material naturally trails off either side of the blade to form undesirable windrows.

In an effort to meet these problems and to increase the effective plow width of such a plow or scrapper blade, one prior art device known to applicants proposes auxiliary wings which are mounted to a blow blade. As is described in U.S. Pat. No. 4,741,116 issued 3 May 1988 to Engle et al, wing assemblies may be mounted laterally of a snowplow blade in order to increase the effective width of the blade. These wing assemblies are affixed to each side edge of a plow blade by means of brackets which permanently bolt onto the blade. The wing assemblies project forwardly at an angle of approximately 18° so as to enhance the scooping action of the blade. Outer end resilient guard elements are provided to act as a bumper to help protect the blade during the plowing activity. As is further described in the Engle et al patent, other prior art constructions have been developed to expand or change the blade configuration of a plow blade. A disadvantage here lies in the need to have custon constructed wing assemblies for the plow blades made by different manufacturers.

Despite the improvements of the prior art devices, including those shown in Engle et al, there remains a need for improved constructions of wing assemblies that are fairly universally attachable to different blades to both increase the plow blade's effective width, to increase the plow blade's effectiveness in scooping materials to be scraped or removed and to integrate in a better fashion the scooping and trail-off dumping of materials. The present invention has been constructed to provide such improvements.

SUMMARY OF THE INVENTION

It is an object of the present invention to provide a new and useful wing assembly and plow blade combination that is inexpensive to manufacture and simple to use.

Another object of the present invention is to provide a wing attachment that may be universally mounted to a variety of different plow blades.

A further object of the present invention is to provide a wing assembly that is hingedly secured to a plow blade to facilitate mounting and removal of the attachment from the primary blade.

Yet another object of the present invention is to provide a wing assembly that projects forwardly and outwardly of a main plow blade at an angle that is integrated to the angle of cant of the blade plow so as to maximize scooping action while retaining the ability to trail-off material so scooped.

It is yet a further object of the present invention to provide a blade assembly which is mounted in such a manner that it is protected against excessive impact and which includes a shear assembly to avoid unwanted destruction of the auxillary wing assembly.

According to the present invention, then, a wing assembly is provided by the present invention and is adapted to mounted on a plow blade. Typically, such plow blade has a plowing surface bounded by a lower edge, an upper edge and a pair of side edges so that it has an effective plowing width between the side edges. Such plow blade is secured to and driven by a vehicle in a selected direction of travel. The wing assembly according to the invention, then, is operative to increase the effective plowing width by providing at least one, but preferably two, wing plates each of which has a front surface that defines an auxillary plowing surface bounded by an upper wing edge, a lower wing edge, an inboard wing edge and an outboard wing edge. A hinge structure is provided on a selected side edge of the plow blade to mount such wing plate, and the wing plate has mounting structure located on a central portion of the wing plate. This mounting structure engages the hinge structure so that is releasably secures the wing plate to the plow blade along the side edges in a pivotal manner so that the wing plate can move into an attached position wherein the inboard edge is proximate the plow blade. Releasable locking structure is provided to releasably secure the wing plate in the attach position with the inboard edge adjacent the plow blade.

As noted, it is preferred that a pair of wing blades be provided, one on either side fo the plow blade. While it is possible that the inboard edge of such wing plates can be located either forwardly or rearwardly of the plow blade, it is preferred that each wing plate be mounted forwardly of the plow blade so that the inboard edge of each wing plate is adjacent to the plowing surface. The hinge structure may then be formed by a pair of vertically extending trunnion pins which define a pivot axle; the mounting structure may then comprise brackets mounted on the rear surface of each wing plate with these brackets having openings that engage the trunnion pins. The mounting brackets may be formed as a pair of spaced-apart relatively parallel webs, at least one of which includes an angular extension forming a triangular brace portion positionable between the plow blade and the wing plate when the wing plate is in the attack position so that the angular portion operates positively to support the wing plate against this plow blade.

Since the typical structure of a plow blade provides that it is C-shaped in vertical cross-section thereby forming the plowing surface along a cylindrical section contour, the inboard edge of the wing plate may be formed as an elliptical arc that will conform to the imaginary intersection of the plow blade with the plane of the wing plate. Further, it is preferred that the inboard edge be locked to the plow blade by means of a latch post that will penetrate an opening formed in the plow blade. This latching post may be secured by a latch pin, that may be a shear pin. Where the wing plate is mounted forwardly of the plow blade, the latch post projects rearwardly through the plow blade and is retained by the shear pin. Thus, if the operator of the plow impacts the wing plate against a relatively unmovable surface, the force on the wing plate will cause the shear pin to severe thereby allowing the wing plate to pivot out of position to decrease the likelihood of damage.

Since the typical snowblade includes an assembly allowing it to pivot so that it makes an obtuse angle $\phi$ with respect to the direction of travel, another aspect of this invention provides that the wing plate be mounted to project at an obtuse angle $\theta$ wherein $160° \geqq 0 \geqq 275° - \phi$. As such, the angle of the wing plate can maximize scooping action while still being able to allow trailing off of the scooped material when the plow blade is canted at an $\phi$.

These and other objects of the present invention will become more readily appreciated and understood from a consideration of the following detailed description of the preferred embodiment when taken together with the accompanying drawings, in which:

DETAILED DESCRIPTION OF THE PREFERRED EMBODIMENT

The present invention relates to plow blades in general, and specifically to wing assemblies that are attachable to plow and scraper blades in order to extend their effective plowing width and to otherwise enhance the operation of the plow and scrapper blades. The present invention is especially useful in conjunction with snowplow blades, but it should be understood that the principals taught in the present invention may be expanded and used in conjunction with other plow and scrapper blades. Thus, while the preferred embodiment of the present invention is described with respect to snow plow blades, such description is by way of example and not limitation.

Figure 1:
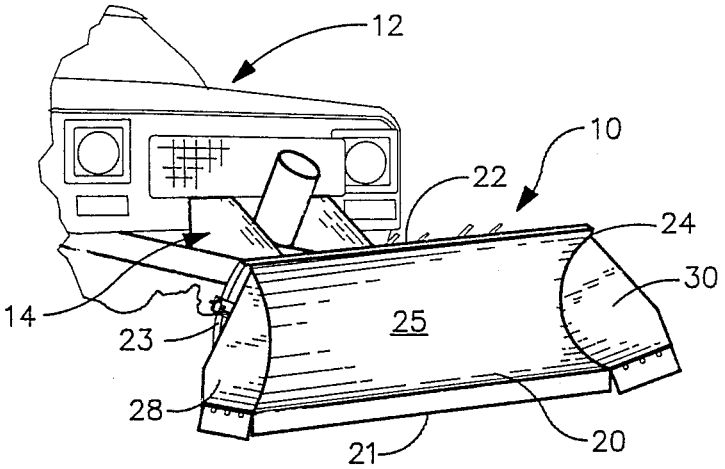
FIG. 1 is a perspective view of the front end of a vehicle having attached thereto a plow blade utilizing the wing assemblies according to the present invention.
Figure 2:
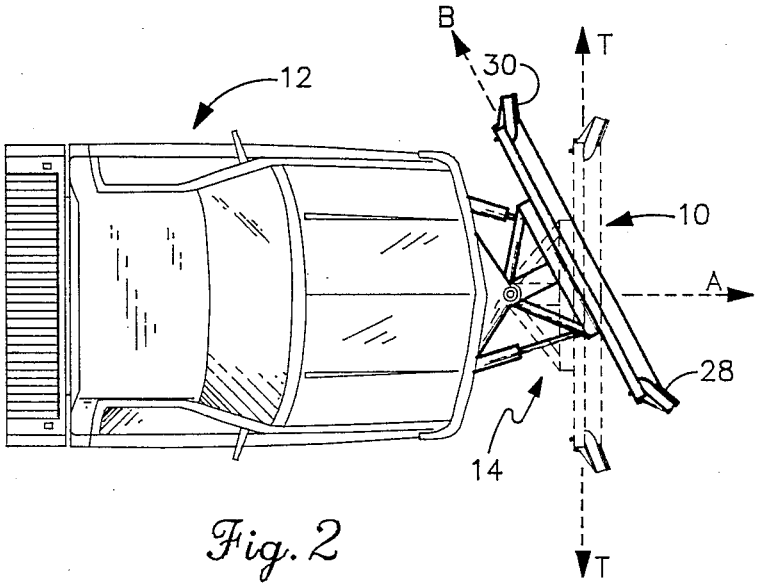
FIG. 2 is a top plan view of the vehicle and plow assembly shown in FIG. 1 and illustrating the canting of the plow blade.

As is shown in FIGS. 1 and 2, a plow blade assembly 10 is mounted to a vehicle 12 by means of a standard hydraulic mounting assembly 14. Plow blade assembly 10 includes plow blade 20 and wing assemblies 28 and 30 mounted respectively on the right and left sides of plow blade 20. Vehicle 12 operates to advance blade assembly 10 in a direction of travel shown by arrow A in FIG. 2, with this direction of travel corresponding to the longitudinal axis of vehicle 12. In normal operation, as is shown in FIG. 1 and in fathom in FIG. 2, plow blade 20 is oriented at a 90° angle, that is, transversely, to the direction of travel A. Plow blade 20 has a lower scrapping edge 21, an upper edge 22 and right side edge 23 and a left side edge 24 which surrounds and bounds plowing surface 25 that forms a front surface for plow blade 20.

Figure 3A:
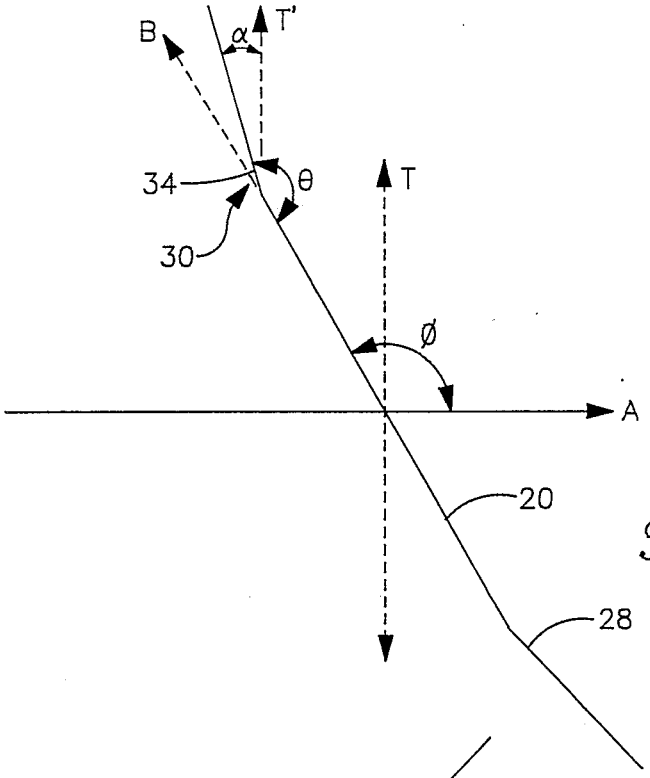
FIGS. 3*a* and 3*b* are diagramic views showing the relationship of the angle of the wing plate to the angle of canting of the plow blade and trail off feature according to the present invention.
Figure 3B:
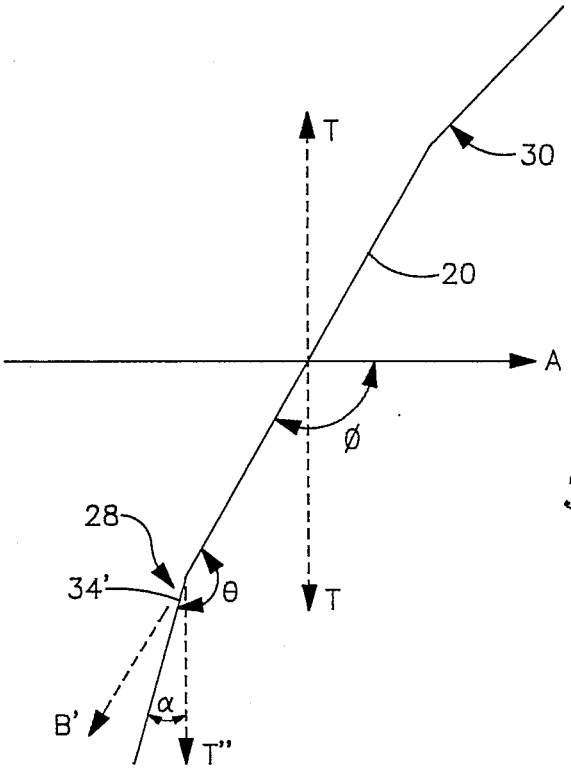

Further, as is known in the industry, hydraulic mounting assembly 14 can be activated to tilt or cant while plow blade 20 to an obtuse angle shown, in FIG. 2, as arrow B which is typically at least 120°. It should be appreciated that arrow B shows plow blade 20 being canted to the left side of vehicle 12, but, while not shown, plow blade 20 may be canted to a similar angle to the right side of vehicle 12. For sake of graphical reference, as is shown in FIGS. 3*a* and 3*b*, plane T represents the transverse plane of plow blade 20 during normal operation where it is transverse to direction of travel A. In FIG. 3*a*, plow blade 20 may be canted at an angle 100, which may be seen as an obtuse angle with respect to the direction of travel A so that plow blade 20 is oriented in a direction corresponding to arrow B. As more thoroughly described below, wing plate 34 of blade assembly 30 is oriented at an obtuse angle $\theta$ with respect to plow blade 20. When the blade 20 is canted at angle $\alpha$ with respect to the direction of travel, wing plate 34 is canted at an angle $\phi$ with respect to plane T', where T' is parallel plane T. Likewise, as is shown in FIG. 3*b*, blade 20 may be canted a similar obtuse angle $\phi$ with respect to the direction of travel A to the right side of the vehicle. Here, the orientation of plow blade 20 is in the plane B' that is at an angle $\phi$ so that, when the plow blade is canted to the right, wing plate 34' of wing assembly 28 is oriented at angle $\alpha$ with respect to plane T'' where T'' is parallel to plane T and wing plate 34' is at an angle $\theta$ with respect to the plow blade.

The structure of the wing plate assembly according to the preferred embodiment of the present invention is best shown in FIGS. 4–7 where, for sake of representation, the structure is described with respect to left wing assembly 30. However, it should be appreciated and understood by the ordinarily skilled person that the structure of wing assembly 28 is simply the mirror image of the structure shown with respect to wing assembly 30 and it is only necessary to describe that structure of representative wing assembly 30 for a complete understanding of both the left and right wing assemblies.

Figure 5:
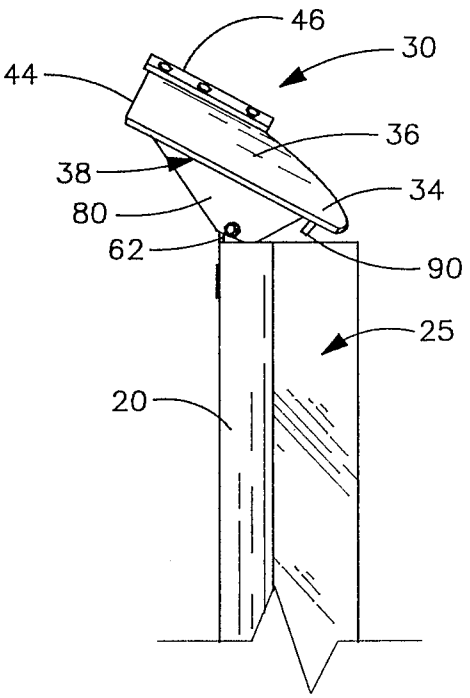
FIG. 5 is a top plan view of the plow blade and wing assembly shown in FIG. 4.
Figure 4:
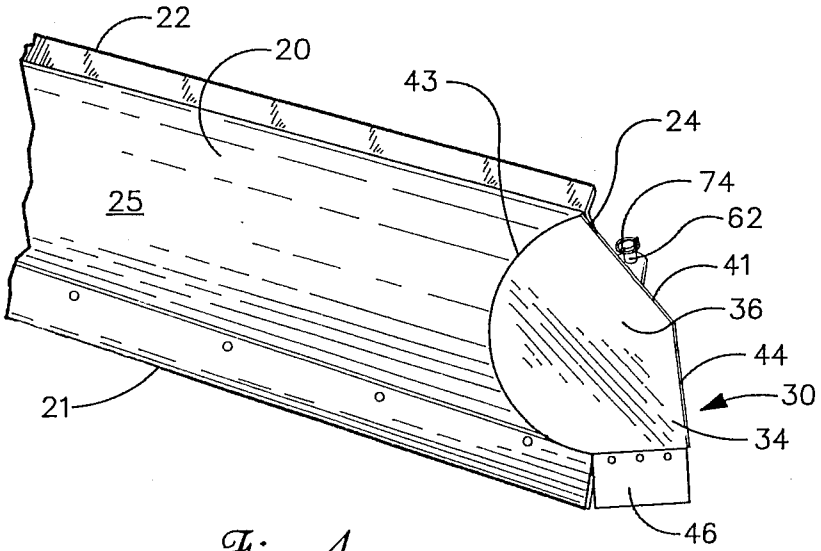
FIG. 4 is a perspective view of a wing assembly according to the present invention partially attached to a plow blade.
Figure 6:
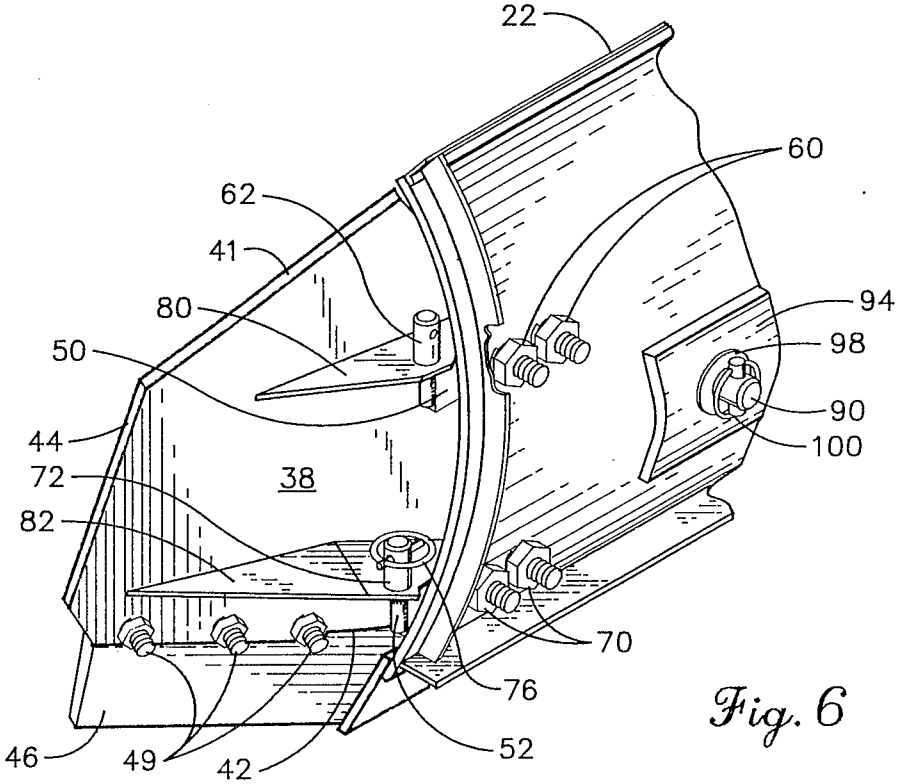
FIG. 6 is a rear view, and partially broken away perspective, showing the full attachment of the wing assembly and plow blade shown in FIGS. 4 and 5.

Turningto FIGS. 4–6, then, it may be seen that wing assembly 30 includes a wing plate 34 that has a front surface 36 and a rear surface 38 opposite surface 36. Front surface 36 defines an auxillary plowing surface, that is bounded by upper wing edge 41, lower wing edge 42, inboard wing edge 43 and outboard wing edge 44. Wing plate 34 is truncated at the corner formed by outboard wing edge and lower wing edge 42 so that lower wing edge 42 is at an acute angle to the surface to be cleaned. A rectangular shaped rubber plate 46 is mounted to wing plate 24 along lower wing edge 42, by means of nut and bolt sets 49, and is operative to extend the auxillary plowing surface.

Figure 7:
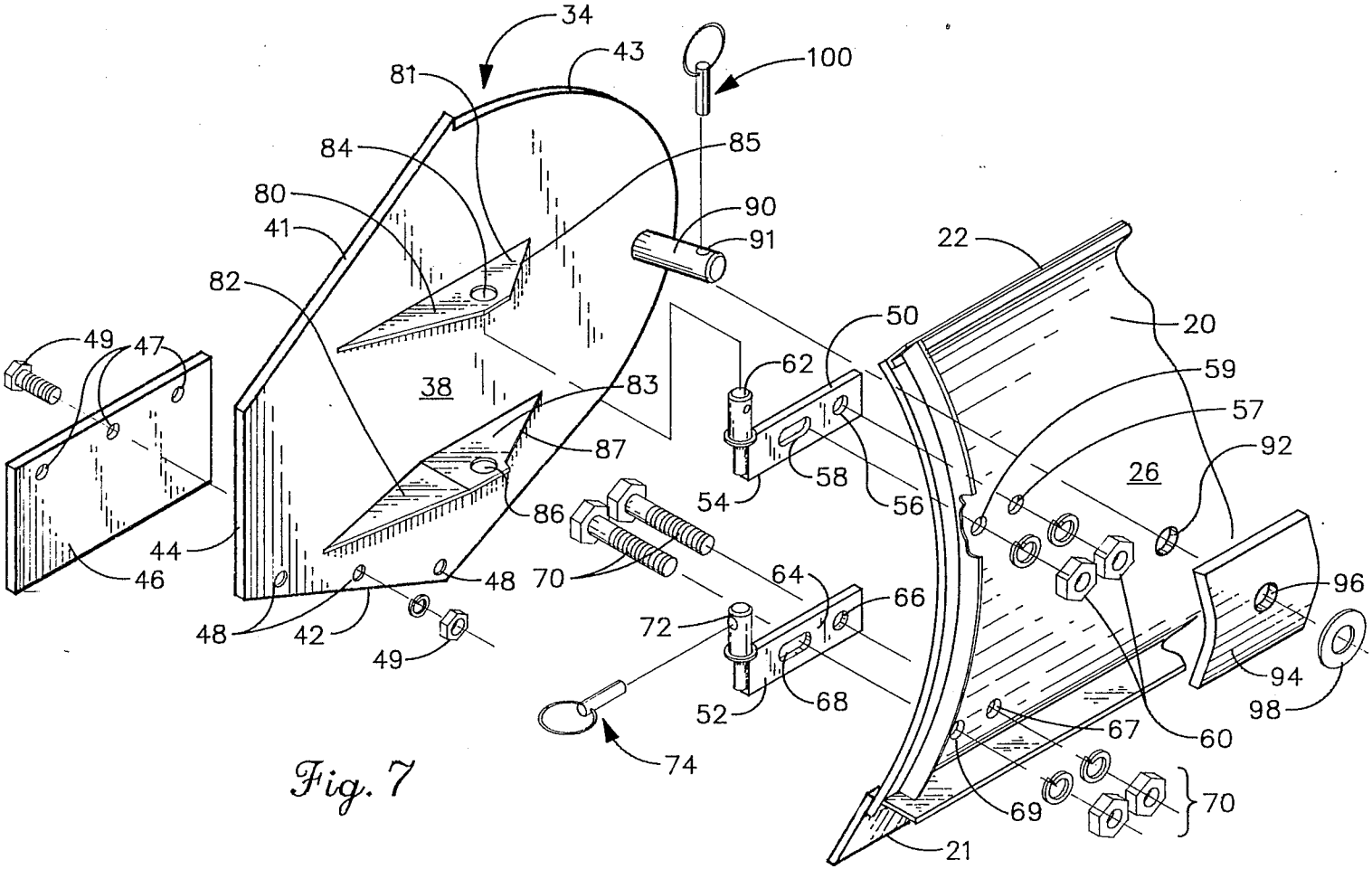
FIG. 7 is an exploded view in perspective showing the attachment of the wing assembly and plow blade of FIGS. 4–6.

Wing assembly 30 is hingedly secured to left side edge 24 of plow blade 20, as is best shown in FIGS. 5–7. Here, it should be appreciated that an upper hinge element 50 and a lower hinge element 52 are bolted or otherwise attached to plow blade 20 proximate left edge 24. To this end, upper hinge element 50 includes plate 54 having bolt openings 56 and 58 formed therein; opening 58 is elongated so as to provide for ease of attachment by means of nut and bolt sets 60 which extend through bolt holes 57 and 59. A vertically upwardly extending trunnion pin 62 is attached to the outer end of plate 54 such as by welding. Similarly, lower hinge element 52 is constructed as a plate 64 having a pair of bolt openings 66 and 68 similar to bolt openings 56, 58 of upper hinge element 50. Lower hinge element 52 is then secured to plow blade 20 by means of nut and bolt sets 70 which respectively pass through lower bolt holes 67 and 69 formed in plow blade 20. Lower trunnion pin 72 is attached to plate 64, such ab by welding, and extends vertically upwardly along a common axis with trunnion pin 62. Accordingly, trunnion pins 62 and 72 define a pivot axis located proximate left edge 24 of plow blade 20 upon which wing plate 34 may be pivotally attached.

To this end, as is best shown in FIGS. 6 and 7, a mounting bracket assembly in the form of upper web 80 and lower web 82 are attached to rear surface 38 centrally of wing plate 34. Webs 80 and 82 may be welded on wing plate 34 so that they project rearwardly from rear surface 38 in generally horizontal spaced apart planes. Upper web 80 includes an upper opening 84 sized and positioned to engage upper trunnion pin 62. Likewise, lower web 82 includes lower opening 86 sized and positioned to engage lower trunnion pin 72. Spring clips 74 and 76 respectively retain the trunnion pins 62, 72 in the engaged position.

It may therefore be seen that trunnion pins 62, 72 and openings 84, 86 provide hinge and mounting means for pivotally securing wing plate 34 on the plow blade 20 along the side edge 24 with wing plate 34 being pivotable about the pivot axis defined by co-axial trunnion pins 62 and 72. This pivotal motion allows wing plate 34, and thus wing assembly 30, to pivot from an intermediate position shown in FIG. 5 to the attack position shown in FIGS. 1, 2, 4 and 6. When in the attack position, it may be readily seen from FIGS. 1 and 2 that the front surface 36 of wing plate 34 forms an auxillary plowing surface that extends the effective plowing surface 25 of plow blade 20. Further, from the foregoing, it should be readily understood that it would be equivalent to interchange trunnion pins 62, 72 and holes 84, 86 so that the trunnion pins could be mounted on webs 80, 82 while the mating openings could be constructed on hinge elements 50 and 52 without departing from the scope of this invention.

As may be seen in FIGS. 7, and as should be well know to the ordinarily skilled person in this field, typical plow blade 20 is C-shaped in cross-section along a vertical plane containing the axis of the direction of travel. Thus, plow blade 20 and plowing surface 25 follow a generally cylindrical contour along a cylindrical section. As described above, when in the attack position, wing plate 34 is oriented in a plane that is at an obtuse angle $\theta$ with respect to plow blade 20: inboard edge 43 is therefore preferably configured along an elliptical arc that conforms to the cylindrical contour of plow blade 20. Thus, inboard edge 43 may be placed in close proximity to plowing surface 25 of plow blade 20 in the attack position. Further, with reference to FIGS. 5, 6 and 7 it may be appreciated that a releasable locking means secures the wing plate in the attack position. As may be seen in the Figures, this releasable locking means may preferably be a latch post 90 which is attached to rear surface 38 of wing plate 34 adjacent inboard edge 43 and which projects rearwardly of rear surface 38. Plow blade 20 is provided with a latch post opening 92 located and sized to matably receive latch post 90 when inboard edge 43 moves proximate plow blade 20 as wing plate 34 is pivoted on trunnion pins 62 and 72. Latch post 90 thus penetrates latch opening 92 when wing plate 34 is in the attack position. An auxillary strengthening plate 94 is mounted on rear surface 26 of plow blade 20 and includes hole 96 aligned with hole 92 so as to receive latch post 90. When in the attack position, a washer 98 may be utilized around latch post 90 and the wing assembly 30 locked in the attack position by means of spring clip 100 which is received in transverse bore 91 of latch post 90 and which may serve as a shear pin in operation, as described below. Accordingly, it may be seen that wing assembly 30 may be secured in the attack or "plowing" position when clip 100 secures latch post 90 against disengagement from plow blade 20.

In operation, once hinge elements 50 and 52 are attached to plow blade 20, and latch opening 92 formed in plow blade 20, it becomes a simple matter to mount wing assembly 30 to plow blade 20. Here, webs 80 and 82 are first positioned on hinge elements 50, 52 in the position shown in FIG. 5, and the assembly is pivoted to engage latch post 90 with plow blade 20, and the latch post 90 is locked into position. It should further be appreciated that, in order to help support wing plate 34, at least one of webs 80, 82 is provided with an angularly extending portion. Thus, as may be seen in FIGS. 6 and 7, web 80 includes an angular extension 81 while web 82 includes an angular extension 83 that respectively have edges 85 and 87 that will abut front plowing surface 25 of plow blade 20 when wing assembly 30 is in the attack position. Angular extension 81 should have an inboard vertex formed at an angle that is the supplementary angle to angle $\phi$.

Referring again to FIG. 3*a*, it should be important to note that obtuse angle $\theta$ of wing plate 34 to plow blade 20 must be selected by some degree of care, depending upon the ability of mounting assembly 14 to cant plow blade 20 away from the direction of travel. At this same time, it is important that angle $\theta$ be small enough to help retain snow or other material when plow blade 20 is oriented transversely to the direction of travel. To this end, where $\phi$ is the angle at which plow blade 20 may be canted away from the direction of travel, it is important that wing plate 34 have at least an angle $\alpha$ of 5° rearwardly of the transverse plane T'. Any angle less than this 5° is less desirable since it will reduce or prevent suitable trailing off of the scraped material after it has been gathered by plowing surface 25 and the auxillary plowing surfaces provided by wing assemblies 28 and 30. Accordingly, should angle $\theta$ be too small, the operator will not be able to trail off the scrapped material. However, if $\theta$ is too large, insufficient scooping action will result. Preferably, $\theta$ is selected to be 155°–160°. Where $\phi$ is 120°, this allows a 5°–10° trailing off angle for wing plate 34. Accordingly, it should be understood that the relationship between the two angles $\theta$ and $\phi$ may be expressed, according to the preferred embodiment of the present invention, as $160° \geqq \theta \geqq 275° - \phi$, where $\phi$ is the obtuse angle which plow blade 20 may be canted away from the direction of travel and where $\theta$ is the obtuse angle which the wing plate, such as wing plate 34, mates with plow blade 20.

While the above described preferred embodiment mounts the entire wing plate 34 forwardly of plow blade 20, it is possible to provide an alternative structure incorporating the concepts of the present invention wherein an inboard portion of the wing plate is mounted rearwardly of plow blade 20. This alternate structure is shown in FIGS. 8–11. In these figures, plow blade 120 is modified by mounting a pair of latch posts 190 on rear surface 126 of plow blade 120 so that each latch post 190 projects rearwardly of surface 126. A pair of hinge elements in the form of upper hinge element 150 and lower hinge element 152 are mounted along side edge 124 and includes, respectively, an upper opening 184 and a lower opening 186. Openings 184 and 186 are aligned with one another to define a hinge axis.

Figure 11:
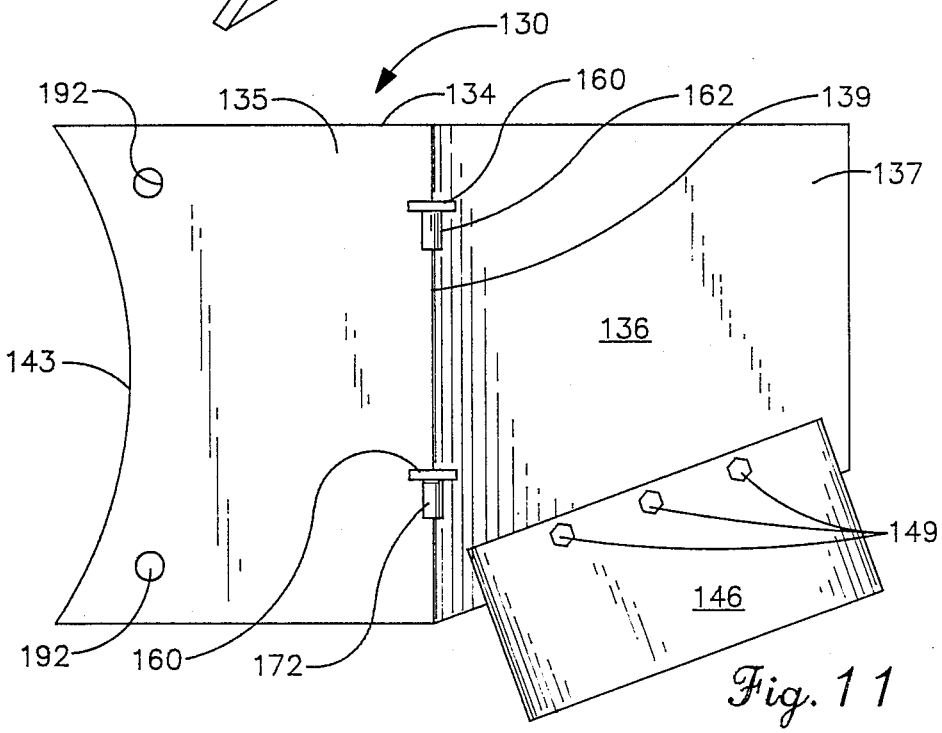
FIG. 11 is a front view in perspective of the wing plate utilized with the alternate embodiment of the present invention shown in FIGS. 8–10.

An alternate wing plate 134, best shown in FIG. 11, has an inboard portion 135 and an outboard portion 137 which are formed at an obtuse angle with respect to one another about junction line 139. Upper and lower brackets 160 and 170 are attached to the front surface of wing plate 134 centrally thereof. An upper trunnion pin 162 and a lower trunnion pin 172 are respectively attached to brackets 160 and 170, and are spaced forwardly of plate 134. Trunnion pins 162 and 172 are vertically aligned with one another and are oriented to engage openings 184 and 186 of brackets 150 and 152, respectively. Inboard plate portion 135 has a pair of latch openings 192 sized and positioned to engage rearwardly projecting latch posts 190 on blade 120. Rubber plate 146 is mounted by means of a plurality of nut and bolt sets 149 and, along with front surface 136 of outboard wing portions 137, defines an auxillary plowing surface when wing assembly 130 is mounted on plow blade 120.

Figure 8:
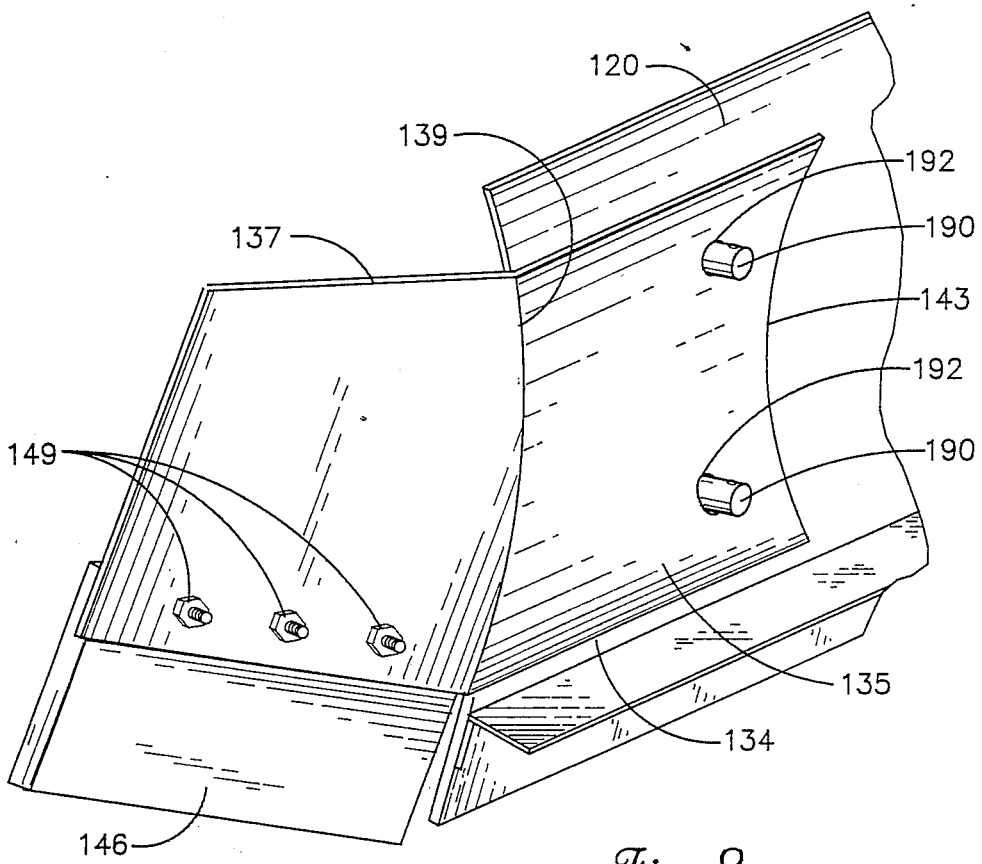
FIG. 8 is a perspective view of an alternate embodiment of the wing plate according to the present invention.
Figure 9:
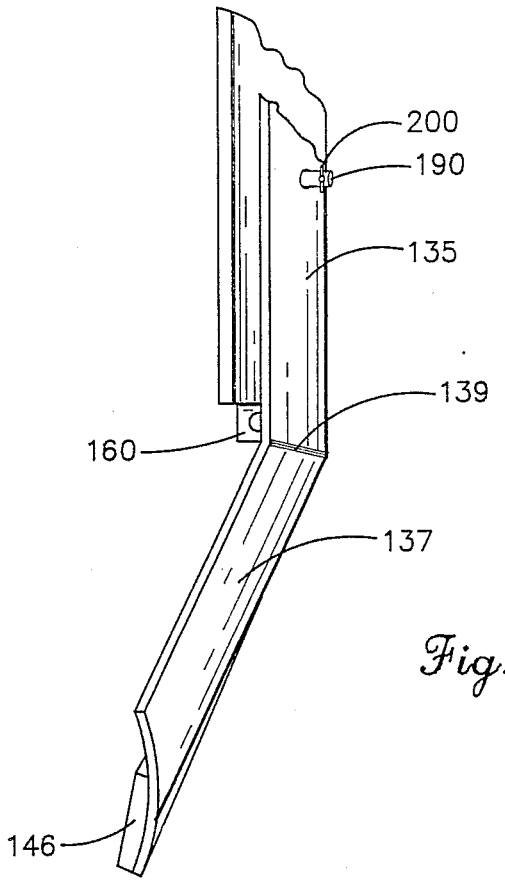
FIG. 9 is a top plan view of the assembly shown in FIG. 8.
Figure 10:
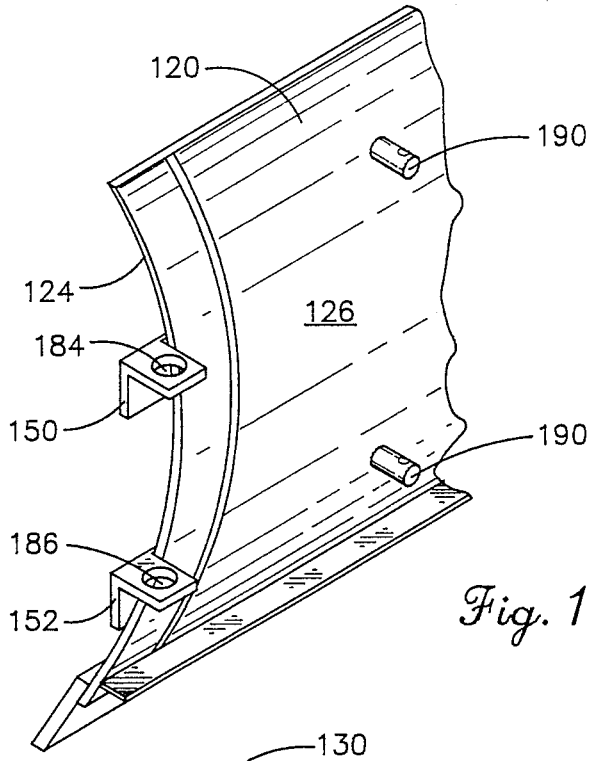
FIG. 10 is a rear view in perspective of the plow blade utilizing the assembly shown in FIGS. 8 and 9.

The mounting of plow blade 120 is best shown in FIGS. 8 and 9 where it can be appreciated that wing plate may be mounted first by inserting trunnion pins 162 and 172 in their respective openings 184 and 186 and clipped into position after which plate 134 may be pivoted so that inboard portion 135 of plate 134 lies adjacent rear surface 126 of plow blade 120. When inboard portion 135 is pivoted into this position, outboard portion 137 is in the attack position at the desired angle $\phi$ and latch posts 190 are matably received in openings 192 where they may be releasably locked into position by means of spring clips 200. Inboard side edge 143 again is configurated to conform to the contour of rear surface 126.

From the foregoing, it should be appreciated that the wing assembly 130 according to the alternative embodiment of the present invention may be constructed so as to mount on the rear of plow blade 120 rather than in front of the plow blade as described with respect to the embodiment of FIGS. 1–7. Further, it should be appreciated and understood that the alternate embodiment shown in FIGS. 8–11 has been described with respect to a left wing assembly. Again, it is totally within the scope of the present invention to provide a right wing assembly which would be the mirror image of the that shown in FIGS. 8–11.

Accordingly, the present invention has been described with some degree of particularity directed to the preferred embodiment of the present invention. It should be appreciated, though, that the present invention is defined by the following claims construed in light of the prior art so that modifications or changes may be made to the preferred embodiment of the present invention without departing from the inventive concepts contained herein

We claim:

1. A wing assembly adapted to be mounted on a plow blade having a plowing surface bounded by a lower edge, an upper edge and a pair of side edges whereby said plow blade has an effective plowing width between said pair of side edges, said plow blade adapted to be mounted to and driven by a vehicle in a direction of travel, said wing assembly operative to increase said effective plowing width and comprising:

a wing plate having a front surface defining an auxillary plowing surface bounded by an upper wing edge, a lower wing edge, an inboard wing edge and an outboard wing edge, said wing plate having a rear surface opposite said front surface;

hinge means attached to a selected one of said side edges of said plow blade for defining an upright pivot axis proximate said side edges;

mounting means on said wing plate for engaging said hinge means along the pivot axis, said mounting means being located centrally of said wing plate, and for releasably securing said wing plate to said plow blade along the selected one of said side edges so that an inboard portion of said wing plate overlays a portion of the front plowing surface of said plow blade, said wing plate being pivotable about said pivot axis so that said wing plate can move to an attack position wherein the inboard edge thereof is proximate said plow blade; and releasable locking means for securing said wing plate in the attack position.

2. A wing assembly according to claim 1 wherein said hinge means and said mounting means include upper and lower trunnion pins respectively on one of said selected side edge and said wing plate and said mounting means comprises a bracket assembly having cooperative upper and lower openings operative to receive respectively said upper and lower trunnion pins on another of said selected side edge and said wing plate.

3. A wing assembly according to claim 2 wherein said upper and lower trunnion pins are attached to said selected side edge and a bracket assembly is attached to said central portion of said wing plate.

4. A wing assembly according to claim 2 including locking pins operative to releasably secure said upper and lower trunnion pins in respective upper and lower openings of said bracket assembly.

5. A wing assembly according to claim 2 wherein said releasable locking means includes a latch post mounted on said wing plate and projecting outwardly at an angle therefrom, said plow blade having a latch opening formed therein, said latch opening and said latch post sized and positioned such that, when the wing plate is moved to the attack position, said latch post matably engages the latch opening and including means for retaining said latch post in engagement therewith.

6. A wing assembly according to claim 5 wherein said latch post has a transverse bore formed therein, said means for retaining said latch post being defined by a shear pin received in the transverse bore and operative to prevent withdrawal of said latch post from the latch opening.

7. A wing assembly according to claim 1 wherein said mounting means includes a bracket assembly operative to position said wing plate obtusely with respect to said plow blade with the outboard edge of said wing plate being disposed forwardly of said plowing surface.

8. A wing assembly according to claim 7 wherein said bracket assembly includes a first web having an angular brace portion positioned between said plow blade and said wing plate when said wing plate is in the attack position and operative to positively support said wing plate against said plow blade.

9. A wing assembly according to claim 8 wherein said wing plate is mounted forwardly of said plow blade with the inboard edge of said wing plate abutting the plowing surface of said plow blade when in the attack position.

10. A wing assembly according to claim 9 wherein said plow blade is C-shaped in vertical cross-section so that the plowing surface is contoured along a cylindrical shell section having a horizontal cylinder axis, the inboard edge of said wing plate being an elliptical edge portion.

11. A wing assembly according to claim 9 wherein said bracket assembly includes a second web, said first and second webs attached to the rear surface of said wing plate and projecting rearwardly therefrom in generally horizontal spaced-apart planes when said wing assembly is mounted on said plow blade.

12. A wing assembly according to claim 11 wherein said hinge means includes a pair of vertically extending trunnion pins spaced from one another a distance substantially equal to the distance between said first and second webs, said first and second webs each having an opening to receive a respective trunnion pin.

13. A wing assembly according to claim 1 wherein said wing plate is truncated at a corner thereof defined by the lower wing edge and the outboard edge to define a truncate edge and including a rubber plate mounted to said wing plate, said rubber plate extending outwardly from the truncate edge as an extension of said auxillary plowing surface.

14. A plowing blade assembly adapted to be secured to and driven by a vehicle in a direction of travel comprising:

a plow blade having a plowing surface bounded by an upper edge, a left and right side edges and a lower edge for scraping, said plow blade having an effective plowing width between said left and right side edges;

means for securing said plow blade to said vehicle;

left and right wing plates mountable to said plow blade respectively along the left and right side edges thereof and projecting forwardly and laterally of said plow blade to increase the effective plow width thereof, each of said left and right wing plates having a front surface defining an auxillary plowing surface bounded by an upper wing edge, a lower wing edge, an inboard wing edge and an outboard wing edge, each said wing plate having a rear surface opposite its front surface;

left and right hinge mounts along the left and right side edges, respectively, of said plow blade, each of said left and right hinge mounts including upper and lower trunnion pins defining a pivot axis;

a left bracket assembly located centrally on the rear surface of said left wing plate and a right bracket assembly located centrally on the rear surface of said right wing plate, each of said left and right bracket assemblies including upper and lower horizontal webs respectively, wherein at least one of said upper and lower horizontal webs includes an angular extension forming a brace, said upper and lower horizontal webs having an upper and lower opening formed therein, said upper and lower openings sized and positioned to receive said upper and lower trunnion pins whereby each respective said wing plate is secured to said plow blade for pivotal movement about the respective pivot axis so that each wing plate may move to an attack position wherein an inboard portion of each said wing plate overlays a portion of said front plowing surface of said plow blade, its inboard edge being proximate the plowing surface of said plow blade with said respective angular extension bracing the wing plate against said plow blade; and releasable left and right locking means for securing respectively the said left and right wing plates in the attack position.

15. A plowing blade assembly according to claim 14 wherein said left and right wing plates are each mounted forwardly of said plow blade so that their respective inboard wing edges are proximate the plowing surface when in the attack position.

16. A plowing blade assembly according to claim 15 wherein said left and right locking means each includes a latch opening formed in the plow blade and a latch post attached to a respective wing plate and projecting rearwardly of its respective sing plate to matably engage a respective latch opening the attack position, and including means for releasably retaining each said latch post in engagement with its respective latch opening.

17. A plowing blade assembly according to claim 14 wherein said angular extension forming a brace abuts said plow blade to positively support a respective wing plate at an obtuse angle to the plowing surface.

18. A plowing blade assembly according to claim 14 wherein said means for securing said plow blade to said vehicle includes means for canting said plow blade at an obtuse angle $\phi$ with respect to the direction of travel, each said wing plate when in the attack position being oriented at an obtuse angle $\theta$ with respect to said plow blade.

19. A plowing blade assembly according to claim 18 wherein said means for canting is able to cant the plow blade at least 120°, and where $160° \geqq \theta \geqq 275° - \phi$.

20. In a plow blade assembly wherein a plow blade is mounted by means of a mounting assembly to a vehicle for advancement in a direction of travel, said plow blade having a front plowing surface bounded by a lower edge for scraping, an upper edge and a pair of side edges, said plow blade oriented transversely of the direction travel during normal use yet capable of being canted by said mounting assembly at an obtuse angle $\phi$ of at least 120° with respect to the direction of travel in order to trail off material gathered by said plowing surface during normal use, the improvement comprising at least one wing plate hinge means attached to a selected one of said side edges for defining an upright pivot axis and means on a central portion of said wing plate for engaging said hinge means, said wing plate being pivotable about said pivot axis, said wing plate mounted to a selected one of the side edges of said plow blade in an attack position such that said wing plate has an inboard portion that overlays a portion of said front plowing surface of said plow blade and an outboard portion that projects forwardly and outwardly of the plowing surface.

21. The improvement according to claim 20 wherein said wing plate defines an auxillary plowing surface bounded by an upper wing edge, a lower wing edge, an inboard wing edge and an outward wing edge and wherein said wing plate is pivotally mounted to the selected side edge along a vertical axis so that it may pivot into the attack position when the inboard wing edge is proximate said plow blade.

22. The improvement according to claim 21 including releasable locking means for securing said wing plate in the attack position.

23. The improvement according to claim 22 wherein two wing plates are provided, there being a said wing plate pivotally mounted along each of the side edges of said plow blade.

* * * * *